United States Patent [19]

Millonzi et al.

[11] 3,961,953

[45] June 8, 1976

[54] METHOD OF FABRICATING COMPOSITE TRIGONAL SELENIUM PHOTORECEPTOR

[75] Inventors: Richard P. Millonzi; Richard W. Radler, both of Marion, N.Y.

[73] Assignee: Xerox Corporation, Stamford, Conn.

[22] Filed: May 28, 1974

[21] Appl. No.: 473,858

[52] U.S. Cl. ..... 96/1.5; 427/124

[51] Int. Cl.[2] ..... G03G 5/04

[58] Field of Search ..... 96/1.5, 1; 427/124

[56] References Cited

UNITED STATES PATENTS

| | | | |
|---|---|---|---|
| 2,476,042 | 7/1949 | Hewlett | 96/1.5 |
| 2,739,079 | 3/1956 | Keck | 96/1.5 |
| 2,753,278 | 7/1956 | Bixby et al. | 96/1.5 |

FOREIGN PATENTS OR APPLICATIONS

| | | | |
|---|---|---|---|
| 16,198 | 7/1968 | Japan | 96/1.5 |

*Primary Examiner*—David Klein
*Assistant Examiner*—John L. Goodrow
*Attorney, Agent, or Firm*—James J. Ralabate; James P. O'Sullivan; Jerome L. Jeffers

[57] ABSTRACT

A method of making a photosensitive imaging device which comprises; vacuum evaporating a thin layer of vitreous selenium onto a supporting substrate, forming a relatively thicker layer of electrically active organic material over said selenium layer, followed by heating said device to an elevated temperature for a time sufficient to convert the vitreous selenium to the crystalline trigonal form. The imaging device is also disclosed.

4 Claims, 2 Drawing Figures

METHOD OF FABRICATING COMPOSITE TRIGONAL SELENIUM PHOTORECEPTOR

BACKGROUND OF THE INVENTION

This invention relates in general to xerography and more specifically to a method of making a photosensitive device.

In the art of xerography, a xerographic plate containing a photoconductive insulating layer is first uniformly electrostatically charged in the dark in order to sensitize the surface of the photoconductive layer. The plate is then exposed to an image of activating electromagnetic radiation, such as light, which selectively dissipates the charge in the illuminated areas of the photoconductive insulator while leaving behind the latent electrostatic image in the nonilluminated areas. The latent electrostatic image may be developed and made visible by depositing finely divided electroscopic marking particles on the surface of the photoconductive layer. This concept was originally described by Carlson in U.S. Pat. No. 2,297,691 and is further amplified and described by many related patents in the field.

Conventional xerographic plates or drums usually comprise a photoconductive insulating layer overlaying a conductive support. A photoconductive material which has had wide use as a reusable photoconductor in commercial xerography comprises vitreous or amorphous selenium. Vitreous selenium in essence comprises super cooled selenium liquid and may readily be formed by vacuum evaporation by cooling the liquid or vapor so suddenly that crystals of selenium do not have time to form. Although vitreous selenium has had wide acceptance for commercial use in xerography, its spectral response is limited largely to the blue-green portion of the electromagnetic spectrum (below about 5200 Angstrom Units). In general, one requirement of a photoconductor, such as vitreous selenium, is that its resistivity should drop at least several orders of magnitude in the presence of activating radiation or light. Also, the photoconductive layer should be able to support a significant electrical potential in the absence of activating radiation.

Selenium also exists in a crystalline form known as trigonal or hexagonal selenium which is well known to the semiconductor art for use in the manufacture of selenium rectifiers. In the crystalline trigonal form, the structure of the selenium consists of helical chains of selenium atoms which are parallel to each other along the crystallographic c-axis. Trigonal selenium is not normally used in xerography as a homogeneous photoconductive layer because of its relatively high electrical conductivity in the dark, although in some instances trigonal selenium can be used in binder structures wherein trigonal selenium particles are dispersed in a matrix of another material such as an electrically active organic material, or a photoconductor such as vitreous selenium.

U.S. Pat. Nos. 2,739,079 and 3,692,521 both describe photosensitive members utilizing small amounts of crystalline hexagonal (trigonal) selenium contained in predominantly vitreous selenium matrices. In addition, copending U.S. patent application Ser. No. 669,915, filed Sept. 22, 1967, describes a special form of red-hexagonal selenium suitable for use in binder structure in which finely divided red-hexagonal selenium particles are contained in a resin binder matrix.

Although trigonal selenium exhibits a wider spectral response than vitreous selenium, as stated above, trigonal selenium is not normally used in xerography because of its relatively high electrical conductivity in the dark. However, imaging structures which are able to use a homogeneous layer of hexagonal selenium would have advantages over those using vitreous selenium with regard to improved spectral response and increased sensitivity. Further, the use of a trigonal selenium layer in a specially constructed xerographic member could provide better overall electrical characteristics than vitreous selenium photoreceptors.

OBJECTS OF THE INVENTION

It is therefore an object of this invention to provide a method of making an imaging device.

It is another object of this invention to provide a method of making an imaging device which has a photoinjecting layer of crystalline trigonal selenium.

It is yet another object of this invention to provide a photosensitive device suitable for imaging in the xerographic mode.

It is a further object of this invention to provide an imaging member which exhibits a panchromatic response and excellent mechanical flexibility.

SUMMARY OF THE INVENTION

The invention is directed to a method of preparing an imaging member and to the imaging member itself which comprises a thin layer of crystalline trigonal selenium contained on a supporting substrate, with a layer of electrically active transport material overlaying the trigonal selenium layer. The process of making the device comprises vacuum evaporating a thin amorphous selenium layer of the required thickness onto the supporting substrate. The amorphous selenium layer is then coated with a very thin layer of electrically active material. This layer prevents vaporization of the selenium during the subsequent thermal treatment. The amorphous selenium layer is then transformed to the crystalline trigonal form in situ by heat treating the device under critically controlled conditions resulting in the transformation of the amorphous selenium to the crystalline trigonal form. A thicker layer of the electrically active material of appropriate thickness is then coated over the thin initially coated active layer. In some instances, it is beneficial to add the desired thickness of electrically active material directly to the amorphous selenium in the first instance in one step. This procedure eliminates the need for the thin protective coating described above. In this case, the amorphous selenium is converted to the trigonal form by heat treating the entire device under critically controlled conditions.

The above device or imaging member is suitable for use in a xerographic-type imaging system in which the free surface of the active layer is uniformly charged to a given polarity and then exposed to radiation to which the electrically active transport layer is substantially non-absorbant or transparent, and to which the photoconductive trigonal selenium layer is substantially absorbing. Positive or negative electrical charges ("holes" or electrons) generated by the trigonal selenium layer are injected into the transport layer and moved to the surface to selectively discharge the surface charge, resulting in the formation of a latent electrostatic image which may be later developed to form a visible image.

DETAILED DESCRIPTION OF THE INVENTION

Figure 1:
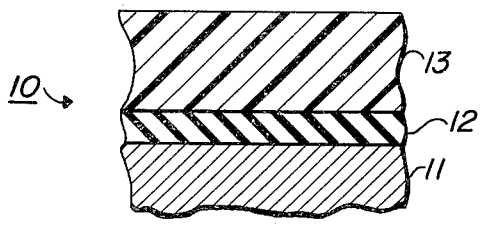
FIG. 1 illustrates one embodiment of an imaging member of the present invention.

The trigonal selenium layers of the present invention are used in a composite imaging member suitable for use in xerographic type imaging. The figure in the drawing illustrates a suitable imaging device for such a trigonal selenium layer. In the figure, reference character 10 illustrates an imaging member comprising a supporting substrate 11 overlayed with a thin layer of crystalline trigonal selenium which is covered with a relatively thicker layer of an organic electrically active material 13. The imaging member may be in any form such as a flat plate, drum or cylinder, drum scroll or a flexible endless belt.

The substrate 11 is preferably made up of any suitable conductive material. Typical conductors comprise aluminum, steel, brass conducting polymers or the like. The substrate may be rigid or flexible and of any convenient thickness. The substrate may also comprise a composite structure such as a thin conductive coating contained on a paper base; a plastic coated with a thin conductive layer such as aluminum, graphite, copper iodide; or glass coated with a thin conductive coating of chromium or tin oxide. If desired, the substrate may also be a substantial dielectric or electrically insulating material and the device charged by techniques well known to the art of xerography when using imaging members having electrically insulating substrates.

Trigonal selenium layer 12 is formed by the techniques already described and must be maintained in a critical thickness range of about 0.03 to 0.8 microns in order for the device to function effectively. Thicknesses below about 0.03 microns do not absorb sufficient amounts of light and, therefore, do not generate sufficient numbers of electrical charges, while thicknesses about 0.8 microns result in an excessively high dark conductivity and the plate will not function adequately to be useful in imaging.

In general, the active layer 13 may comprise any suitable transparent organic polymer or nonpolymeric material capable of supporting the injection of photoexcited holes from the photoconductive layer and allowing the transport of these holes through the organic layer to selectively discharge a surface charge. Typical polymers include poly-n-vinylcarbazole (PVK), poly-1-vinylpyrene (PVP), poly-9-vinylanthracene and others. Typical nonpolymeric materials include carbazole, pyrene, tetra phenyl pyrene, benzochrysene, perylene, tetracene, pycene, fluorene, fluorenone and naphthalene. A larger group of suitable materials for use in layer 13 are more fully described in copending application Ser. No. 371,647, filed on June 20, 1973, which are incorporated herein by reference.

Alternatively, an electron transport material may also be used for layer 13. A typical electron transport material comprises 2,4,7-trinitro-9-fluorenone (TNF). The TNF may be used alone or in combination with relatively electrically inactive organic materials such as polyesters or complexed with other active materials such as polyvinyl carbazole.

In general, the thickness of the active layer should be from about 5 to 100 microns, but thicknesses outside this range can also be used.

In imaging the above device, the free surface of the active material is uniformly electrostatically charged to a given potential. The device is then exposed to a pattern of activating radiation of a wavelength such that the layer 13 is substantially nonabsorbing or transparent to the imaging light. This light generates electron-hole pairs in photogenerating layer 12 and for hole transport materials, positive charges or holes are injected into and transported through active layer 13 to selectively discharge a surface charge which results in the formation of a latent electrostatic image. This image may then be developed in any conventional manner to form a visible image.

It is not the intent of this invention to restrict the choice of active materials to those which are transparent in the entire visible region. For example, when used with a transparent substrate, imagewise exposure may be accomplished through the substrate without the light passing through the layer of active material. In this case the active material need not be nonabsorbing in the wavelength region of use.

Figure 2:
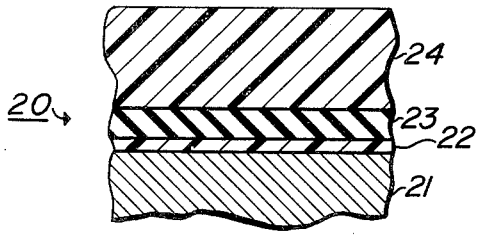
FIG. 2 illustrates a second embodiment of an imaging member of the present invention.

Another modification of the layered configuration is described in FIG. 2 and optionally includes the use of a blocking layer at the substrate-photoconductor interface. This configuration is illustrated by photosensitive member 20 in which the substrate 21, and trigonal selenium photoconductive layer 23 are separated by a blocking layer 22. Active transport layer 24 overlays photoconductive layer 23. The blocking layer functions to prevent the injection of charge carriers from the substrate into the photoconductive layer. Any suitable blocking material may be used. Typical materials include nylon, epoxy, aluminum oxide, polyesters, polycarbonates, copolymers and blends of various polymers.

It is preferred that trigonal selenium photoconductor and the active organic material should be selected or matched to provide that the active layer be nonabsorbing to light in the wavelength region used to generate photoexcited carriers in the photoconductive layer for carrier injection into the active organic layer. This preferred region of xerographic utility is from about 4,000 to 7,000 Angstrom Units. In addition, the trigonal selenium being responsive to most wavelengths from 4,000 to 7,000 Angstrom Units is suitable for a panchromatic response.

DESCRIPTION OF THE PREFERRED EMBODIMENTS

The following examples further specifically define the present invention with respect to a method of making a photosensitive member containing a photoconductive layer of trigonal selenium. The percentages are by weight unless otherwise indicated. The examples below are intended to illustrate various preferred embodiments of the present invention.

EXAMPLE I

An imaging member is made by vacuum evaporating a 0.5 micron layer of amorphous selenium onto a 3 mil aluminum substrate by conventional vacuum deposition techniques such as those disclosed by Bixby in U.S. Pat. Nos. 2,753,278 and 2,970,906. Prior to evaporating the selenium layer onto the substrate, a 0.5 micron layer of an epoxy-phenolic barrier layer is formed over the aluminum by dip coating. Vacuum deposition is carried out at a vacuum of $10^{-6}$ Torr while the substrate is maintained at a temperature of about 50°C during the vacuum deposition. A 10 micron layer of poly-1-vinylpyrene (PVP) is coated over the amorphous selenium layer. The PVP polymer is synthesized according to the method outlined for the cationic polymerization of Sorensons and Campbell's "Preparative Methods of Polymer Chemistry", 1968 Edition, page 267. Five grams of PVP are dissolved in chloroform to make a 10 percent by weight solution. This solution is then coated over the amorphous selenium layer to form a dried layer of about 10 microns thick. The amorphous selenium layer is then converted to the crystalline trigonal form by heating the entire device to 100°C and maintaining this temperature for about 16 hours. At the end of 16 hours, the device is cooled to room temperature. X-ray examination showed no evidence of any substantial amount of vitreous selenium.

EXAMPLE II

A visible image is made using the device formed in Example I by uniformly corona charging the plate in the dark to a negative field of about 50 volts per micron, followed by exposing the charged plate to a pattern of light from a tungsten light source to form a latent electrostatic image. The tungsten light source is filtered to eliminate all radiation below 4,000 Angstrom Units. The latent image is developed with toner particles to form a visible image.

EXAMPLE III

In order to investigate various heat-treating times, temperatures, cooling rates and their effects on the resultant final imaging member, a series of 16 plates were made using the techniques set forth in Example I except that the active layer comprises polyvinyl carbazole in a thickness range of about 5 to 20 microns as the active top layer and the barrier layer was omitted. In addition, the plates were made by first depositing a very thin layer of PVK, approximately 1 micron thick over the selenium followed by heat treating the structures under the appropriate conditions. The plates were then overcoated with a thicker layer of PVK and the entire structure vacuum dried at 40°C overnight to dry the thicker PVK layer. The polyvinyl carbazole solution is made to a concentration of about 9 weight percent PVK by dissolving the appropriate amount of PVK in a solution of chloroform. The polyvinyl carbazole layer is formed by applying the stock solution of PVK over the amorphous layer using a Bird Applicator.

The 16 plates prepared by the above technique are heat treated for various times at various temperatures and cooled (quenched) to room temperature at various rates. In practice, the 16 plates were divided into 8 sets — each set containing two plates. Eight different thermal treatments were employed — the plates of each set being treated under different thermal conditions from the plates in every other set. The two plates within a given set, however, are treated identically. The electrical characteristics of each plate are then measured with respect to charge acceptance, dark discharge rate and photodischarge rate. The average value of these for each set are given in the Data Table.

For comparison, four additional plates are made by the technique set forth above using relatively shorter heating times and substantially lower temperatures in order to compare the criticality of the conversion technique. These plates, designated plates 17–20, respectively, were only heated for 1 or 2 minutes at 95°C and their electrical properties similarly are recorded in the Data Table. Four additional samples were made at 70°C but their electrical characteristics were so vastly inferior that it may be said that they were virtually inoperable for xerographic utility.

DATA TABLE

| Set No. | Plate No. | Thickness PVK Layer | Thickness Trig Se Layer | Heat Treating Time, Temp. & Cooling Rate | Charge Acceptance as Field (volts/micron) at***Q=1.07 × $10^{-7}$cou/cm² | Charge Acceptance as Field (volts/micron) at***Q=3.56 × $10^{-7}$cou/cm² | Average Dark Discharge volts/ micron-sec. | Average Photodischarge Rate volts/ micron-sec. |
|---|---|---|---|---|---|---|---|---|
| 1 | 1 | 9 | 0.25 | 1 Hour 125°C Slow** Quench | 19 | 62 | 9.3 | 220 |
| | 2 | 10 | | | | | | |
| 2 | 3 | 7 | 0.25 | 1 Hour 180°C Slow Quench | 24 | 70 | 6.1 | 248 |
| | 4 | 8 | | | | | | |
| 3 | 5 | 5 | 0.25 | 16 Hour 125°C Slow Quench | 39 | 101 | 4.9 | 240 |
| | 6 | 8 | | | | | | |
| 4 | 7 | 8 | 0.25 | 16 Hour 180°C Slow Quench | 34 | 99 | 3.4 | 353 |
| | 8 | 4 | | | | | | |
| 5 | 9 | 14 | 0.25 | 1 Hour 125°C Fast** Quench | 31 | 72 | 7.5 | 153 |
| | 10 | 20 | | | | | | |
| 6 | 11 | 7 | 0.25 | 1 Hour 180°C Fast Quench | 39 | 100 | 2.0 | 291 |
| | 12 | 11 | | | | | | |
| 7 | 13 | 9 | 0.25 | 16 Hour 125°C Fast Quench | 26 | 84 | 4.1 | 282 |
| | 14 | 10 | | | | | | |
| 8 | 15 | 11 | 0.25 | 16 Hour 180°C Fast Quench | 34 | 88 | 3.9 | 275 |
| | 16 | 6 | | | | | | |

DATA TABLE-continued

| Set No. | Plate No. | Thickness PVK Layer | Thickness Trig Se Layer | Heat Treating Time, Temp. & Cooling Rate | Charge Acceptance as Field (volts/micron) at***Q=1.07 × $10^{-7}$cou/cm² | Charge Acceptance as Field (volts/micron) at***Q=3.56 × $10^{-7}$cou/cm² | Average Dark Discharge volts/ micron-sec. | Average Photodischarge Rate volts/ micron-sec. |
|---|---|---|---|---|---|---|---|---|
| | 17* | 16 | | 1 Min. | | | | |
| | | | 0.25 | 95°C | 17 | 35 | 7.5 | 175 |
| | 18* | 17 | | | | | | |
| | 19* | 12 | | 2 Min. | | | | |
| | | | 0.25 | 95°C | 15 | 23 | 8.7 | 181 |
| | 20* | 15 | | | | | | |

*Structure comprises mixture of vitreous selenium and trigonal selenium crystals.
**Slow quench was accomplished by cooling to room temperature in 30 – 45 minutes. Fast quench was accomplished by cooling to room temperature in 3.5 minutes.
***Q is surface charge.

In converting the vitreous selenium layer to a layer of crystalline trigonal selenium, the conversion may be carried out at any suitable elevated temperature for any length of time sufficient to cause the conversion. From a practical standpoint, however, the temperature must be sufficiently above room temperature in order for this transformation to be practically carried out in a reasonable time. The data in the table illustrates this fact in that for a few minutes at 90°C, the combination of time and temperature were insufficient to completely transform the amorphous layer to the crystalline form. Further, as seen from the electrical data, samples generally display superior charge acceptance, dark decay, and photospeed values when heated at higher temperatures and/or for longer periods of time. For charge acceptance and photospeed values, these trends are generally more apparent in samples which are slowly cooled to room temperature after heating, than in samples cooled more rapidly. Therefore, it is preferred that the conversion or annealing temperature be at least 90°C for a time of at least 30 minutes. A preferred range for this conversion of amorphous selenium to the trigonal form would be a temperature range of about 125° to 210°C for a time ranging from about 1 to 24 hours. For samples heated for a time ranging from about 8 to 24 hours, the preferred cooling rate would be between about 1 and 5° per minute. Samples heated for a time ranging from about 1 hour to 8 hours can benefit from a more rapid cooling rate — particularly with respect to charge acceptance values. However, as seen in the Data Table, other combinations of time, temperature, and cooling rate can also give rise to good electrical properties. In general, trigonal selenium preparation below temperatures of about 125°C for times less than about 1 hour give rise to inferior xerographic properties.

Although specific components and proportions have been stated in the above description of the preferred embodiments of the present invention, other modifications and ramifications of the present invention would appear to those skilled in the art upon reading the disclosure. These also are intended to be covered in the scope of this invention.

What is claimed is:

1. A method of making a photosensitive imaging device which comprises:

vacuum depositing a 0.03 to 0.8 micron thick layer of vitreous selenium onto a supporting substrate, forming a relatively thicker layer of a substantially transparent electrically organic material over said selenium layer and heating said device to a temperature of from 125° to 210°C for a time of from 1 to 24 hours to convert the vitreous selenium to the crystalline trigonal form.

2. The method of claim 1 in which the electrically active layer comprises a material selected from the group consisting of polyvinyl carbazole, polyvinyl pyrene, 2,4,7-trinitro-9-fluorenone, and mixtures thereof.

3. An imaging device which comprises a supporting substrate, a layer of trigonal selenium about 0.03 to 0.8 microns thick overlaying the substrate and a layer of electrically active organic material overlaying said trigonal selenium layer.

4. The device of claim 3 in which the electrically active layer comprises a material selected from the group consisting of polyvinyl carbazole, polyvinyl pyrene, 2,4,7-trinitro-9-fluorenone, and mixtures thereof.

* * * * *

UNITED STATES PATENT AND TRADEMARK OFFICE

CERTIFICATE OF CORRECTION

PATENT NO. : 3,961,953

DATED : June 8, 1976

INVENTOR(S) : Richard P. Millonzi and Richard W. Radler

It is certified that error appears in the above-identified patent and that said Letters Patent are hereby corrected as shown below:

Column 2, line 16, insert the word "electrostatographic" between the words "an" and "imaging".

Column 2, line 18, insert the word "such" between the words "making" and "an".

Column 3, line 23, insert a comma "," between the words "brass" and "conducting".

Column 4, line 36, delete --nylon, epoxy,-- and insert "nylons, epoxies,".

Column 7, line 45, delete "rate - particularly" and insert --rate, particularly--.

Column 8, line 32, insert the word "active" between the words "electrically" and "organic".

Signed and Sealed this

Seventh Day of September 1976

[SEAL]

*Attest:*

RUTH C. MASON
*Attesting Officer*

C. MARSHALL DANN
*Commissioner of Patents and Trademarks*